US011328886B1

(12) United States Patent
Wu

(10) Patent No.: US 11,328,886 B1
(45) Date of Patent: May 10, 2022

(54) RELAY STRUCTURE

(71) Applicant: Sung-Jen Wu, New Taipei (TW)

(72) Inventor: Sung-Jen Wu, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 0 days.

(21) Appl. No.: 17/090,912

(22) Filed: Nov. 6, 2020

(51) Int. Cl.

| | |
|---|---|
| ***H01H 50/12*** | (2006.01) |
| ***H01H 50/64*** | (2006.01) |
| *H01H 50/36* | (2006.01) |
| *H01H 50/24* | (2006.01) |

(52) U.S. Cl.
CPC ..... *H01H 50/12* (2013.01); *H01H 50/643* (2013.01); *H01H 50/24* (2013.01); *H01H 50/36* (2013.01); *H01H 50/641* (2013.01)

(58) Field of Classification Search
CPC ..... H01H 50/12; H01H 50/643; H01H 50/24; H01H 50/36; H01H 50/641
See application file for complete search history.

(56) References Cited

U.S. PATENT DOCUMENTS

| | | | | |
|---|---|---|---|---|
| 4,758,809 | A * | 7/1988 | Bell | H01H 50/28 335/128 |
| 7,283,026 | B2 * | 10/2007 | Nakamura | H01H 50/043 335/202 |
| 7,710,224 | B2 * | 5/2010 | Gruner | H01H 51/2281 335/78 |
| 9,142,373 | B2 * | 9/2015 | Masui | H01H 50/642 |
| 9,754,747 | B1 * | 9/2017 | Yeh | H01H 50/047 |
| 2018/0269018 | A1 * | 9/2018 | Shimoda | H01H 51/084 |
| 2019/0013172 | A1 * | 1/2019 | Hayashida | H01H 50/56 |

* cited by examiner

*Primary Examiner* — Bernard Rojas

(57) ABSTRACT

A relay structure includes a case; a magnetoelectric assembly; a first leg and a second leg assembled with two ends of the magnetoelectric assembly, respectively; a magnetic conduction assembly having an end electrically connected to the magnetoelectric assembly in a normal condition, and when the magnetoelectric assembly produces electromagnetism, the magnetic conduction assembly is magnetically attracted to and abutted with other end of the magnetoelectric assembly; a driving plate assembled with the top surface of the magnetic conduction assembly; an armature assembly including conductive plates stacked with each other, and having an end bonded with a third leg, and other end extended toward the driving plate and formed with a conductively connecting member, a top end of the driving plate is inserted through the armature assembly; a fourth leg having an end disposed inside the case and formed with a contact member above the conductively connecting member.

6 Claims, 10 Drawing Sheets

RELAY STRUCTURE

BACKGROUND OF THE INVENTION

1. Field of the Invention

The present invention relates to a relay structure, and more particularly to a relay structure applied in the field of electrical and electronics.

2. Description of the Related Art

The coils and contacts of the relay generate heat because of Joule loss when being energized. Although the coil temperature of the relay generally does not exceed 120° C., overvoltage applied on the coil may cause abnormally-high temperature, odor or smoke. When the load generated by arc discharge is frequently switched, the temperature of relay may be abnormally increased in short time due to the arc heat.

The above-mentioned heat is generated under abnormal conditions mostly, and the issue to be discussed herein is the normal heating status of the relay during operation. In general, the internal coil operates based on electromagnetism principle and the electro-thermal principle, and heat energy may exist inside the relay. However, the operation of the relay can be easily affected because of the generated and temporarily-stored heat energy, and among internal components of the relay, the armature is affected greatly by high temperature. The armature of the relay is used to control switching operation of the relay, and an end of the armature is configured to magnetically attract with or release from a leg of the relay, but if the temperature of the armature is too high, the heat energy may be transferred to the circuit board through the leg to affect the operation of the circuit board after the magnetic attraction is conducted. Furthermore, the overheated armature also affects the carrying current to cause disruption of the electronic sequence in the current, and it eventually causes the aforementioned problem.

SUMMARY OF THE INVENTION

The objective of the present invention is to effectively reduce the temperature generated on the armature during the operation of the relay, so as to increase the carrying current flowing through the armature to maintain the relay in normal operation. In order to achieve the objective, the present invention provides a relay structure includes a case, first to fourth legs, a magnetoelectric assembly, a magnetic conduction assembly, a driving plate, an armature assembly. The magnetoelectric assembly is disposed inside the case and configured to generate electromagnetism, two ends of the magnetoelectric assembly are electrically assembled with the first leg and the second leg, respectively, and a part of the first leg and a part of the second leg are protruded out of the case. The magnetic conduction assembly is disposed inside the case and around the magnetoelectric assembly, an end of the magnetic conduction assembly is electrically connected to one of the two ends of the magnetoelectric assembly, and other end of the magnetic conduction assembly is magnetically attracted to the other of the two ends of the magnetoelectric assembly when the magnetoelectric assembly generates electromagnetism. The driving plate is assembled on a top surface of the magnetic conduction assembly. The armature assembly is disposed inside the case and electrically connected to an end of the third leg, the other end of the third leg is protruded out of the case, the armature assembly further comprises a plurality of conductive plates, each of the plurality of conductive plates has a part stacked and attached with another one of the plurality of conductive plates, and other part stacked hut not attached with another one of the plurality of conductive plates, an end of the armature assembly is bonded with the third leg, and other end of the armature assembly is extended toward the driving plate and formed with a conductively connecting member, and a top end of the driving plate is inserted through the plurality of conductive plates. The fourth leg has an end disposed inside the case and other end protruded out of the case, the end of the fourth leg disposed inside the case is formed with a contact member above the conductively connecting member.

The present invention uses the conductive plates arranged in stack to increase the conductive area of the armature assembly, and the increase in the conductive area can obviously increase the carrying current and also dissipate the heat generated inside the replay; in this way, when the conductively connecting member of the armature assembly is magnetically attracted with the contact member to form the conductive status, the operation and conduction of the relay and the circuit hoard can be prevented from being affected by excessive heat, so that the relay can be maintained in the normal operation.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
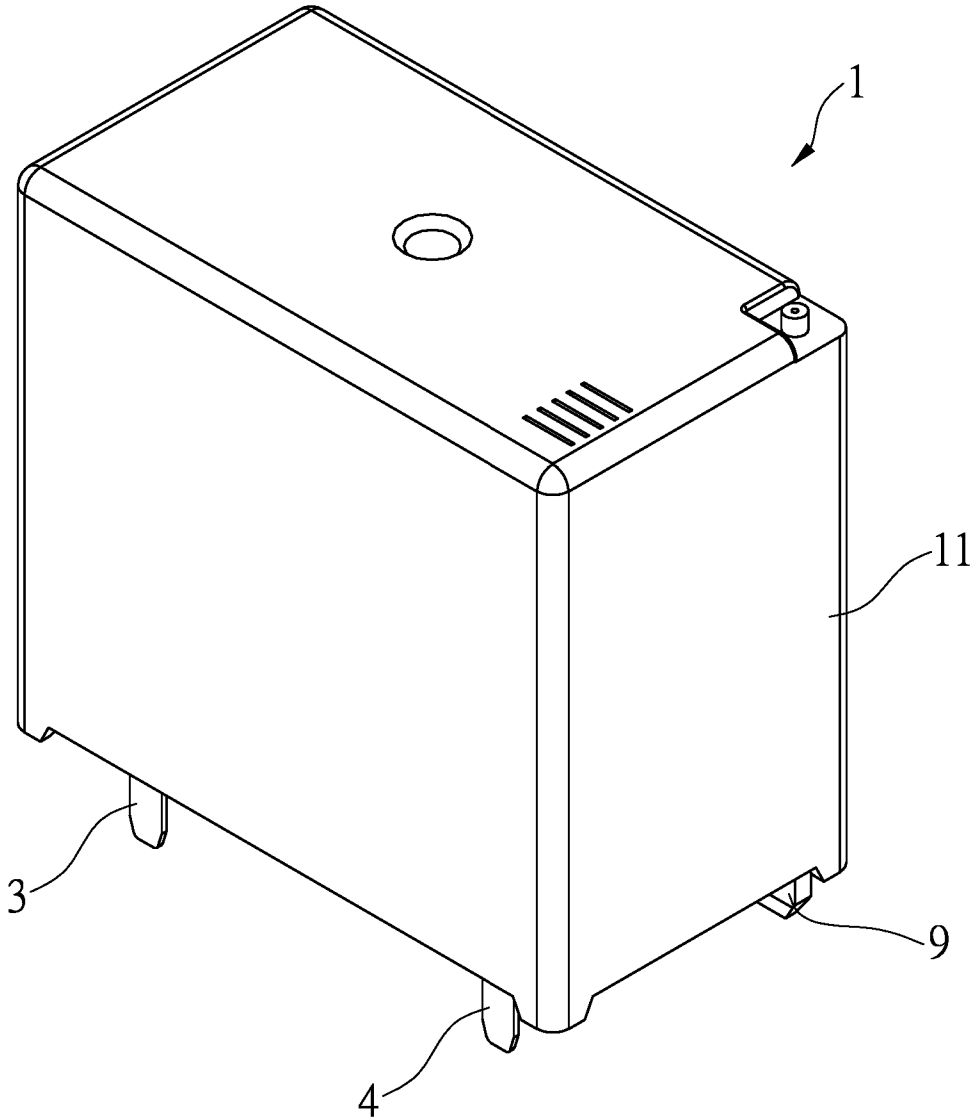
FIG. 1 is a perspective view of a relay structure of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and hilly conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In, addition, unless explicitly described to the contrary, the word "comprise" and variations such as "comprises" or "comprising", will be acknowledged to imply the inclusion of stated elements but not the exclusion of any other elements.

Please refer to FIGS. 1 to 9. The relay structure of the present invention includes a case 1, a magnetoelectric assembly 2, a first leg 3, a second leg 4, a magnetic conduction assembly 5, a driving plate 6, an armature assembly 7, a third leg 8, and a fourth leg 9. The magnetoelectric assembly 2 is disposed inside the case 1 and configured to generate electromagnetism. The first leg 3 and the second leg 4 are electrically assembled with two ends of the magnetoelectric assembly 2, and a part of the first leg 3 and a part of the second leg 4 are protruded out of the case 1, the protruded parts of the first leg 3 and the second leg 4 are configured to be inserted into a circuit board or located on the carrier (not shown in figures) of the circuit. The magnetic conduction assembly 5 is disposed inside the case 1 and located around the magnetoelectric assembly 2. For example, the magnetic conduction assembly 5 can be in an inverted-U shape surrounding the magnetoelectric assembly 2. An end of the magnetic conduction assembly 5 is electrically connected to an end of the magnetoelectric assembly 2 in a normal condition, and other end of the magnetic conduction assembly 5 is magnetically attracted to and abutted with other end of the magnetoelectric assembly 2 when the magnetoelectric assembly 2 produces electromagnetism. The driving plate 6 is assembled with the top surface of the magnetic conduction assembly 5. The armature assembly 7 is disposed inside the case 1 and electrically connected to an end of the third leg 8, and the other end of the third leg 8 is extended and protruded out of the case 1. The armature assembly 7 further includes a plurality of conductive plates 71, a part of each of the plurality of conductive plates 71 is stacked with and attached to a part of another of the plurality of conductive plates 71, and other part of each of the plurality of conductive plates 71 is stacked with but not attached to other part of another of the plurality of conductive plates 71. The end of the armature assembly 7 is bonded with the third leg 8, and other end of the armature assembly 7 is extended toward the driving plate 6 and formed with a conductively connecting member 72. A top end of the driving plate 6 is inserted through the plurality of conductive plates 71. An end of the fourth leg 9 is disposed inside the case 1 and formed with a contact member 91 above the conductively connecting member 72, and the other end of the fourth leg 9 is protruded out of the case 1. With the configuration of the plurality of conductive plates 71, after the magnetoelectric assembly 2 produces electromagnetism, the armature assembly 7 can drive the end, where the conductively connecting member 72 is disposed, of the armature assembly 7 to contact the contact member 91 under the magnetic attraction effect of the magnetic conduction assembly 5, so as to form the electrical conduction. Furthermore, the configuration of the plurality of conductive plates 71 can increase a conductive cross-sectional area to effectively reduce the temperature and increase carrying current.

According to the above description, the configuration of the armature assembly 7 increases the conductive cross-sectional area, and where the conductive plates 71 are stacked with but not attached to each other can increase the conductive cross-sectional area, so as to efficiently disperse the heat, generated by the magnetoelectric assembly 2, received in the magnetoelectric assembly 7, so that the armature assembly 7 can be prevented from higher temperature. Furthermore, when the armature assembly 7 is maintained at a lower temperature, the electronic sequence of the current flowing through the armature assembly 7 is no longer interfered by heat and can effectively conduct electrons. Moreover, the increase of the conductive cross-sectional area increases the carrying current without being limited by the cross-sectional area. The conventional relay has only a single piece of armature, so the conduction efficiency of the conventional relay is limited by the withstand temperature of the armature. The relay structure of the present invention having the stacked conductive plates 71 can solve the problems occurred in the conventional relay.

Figure 2:
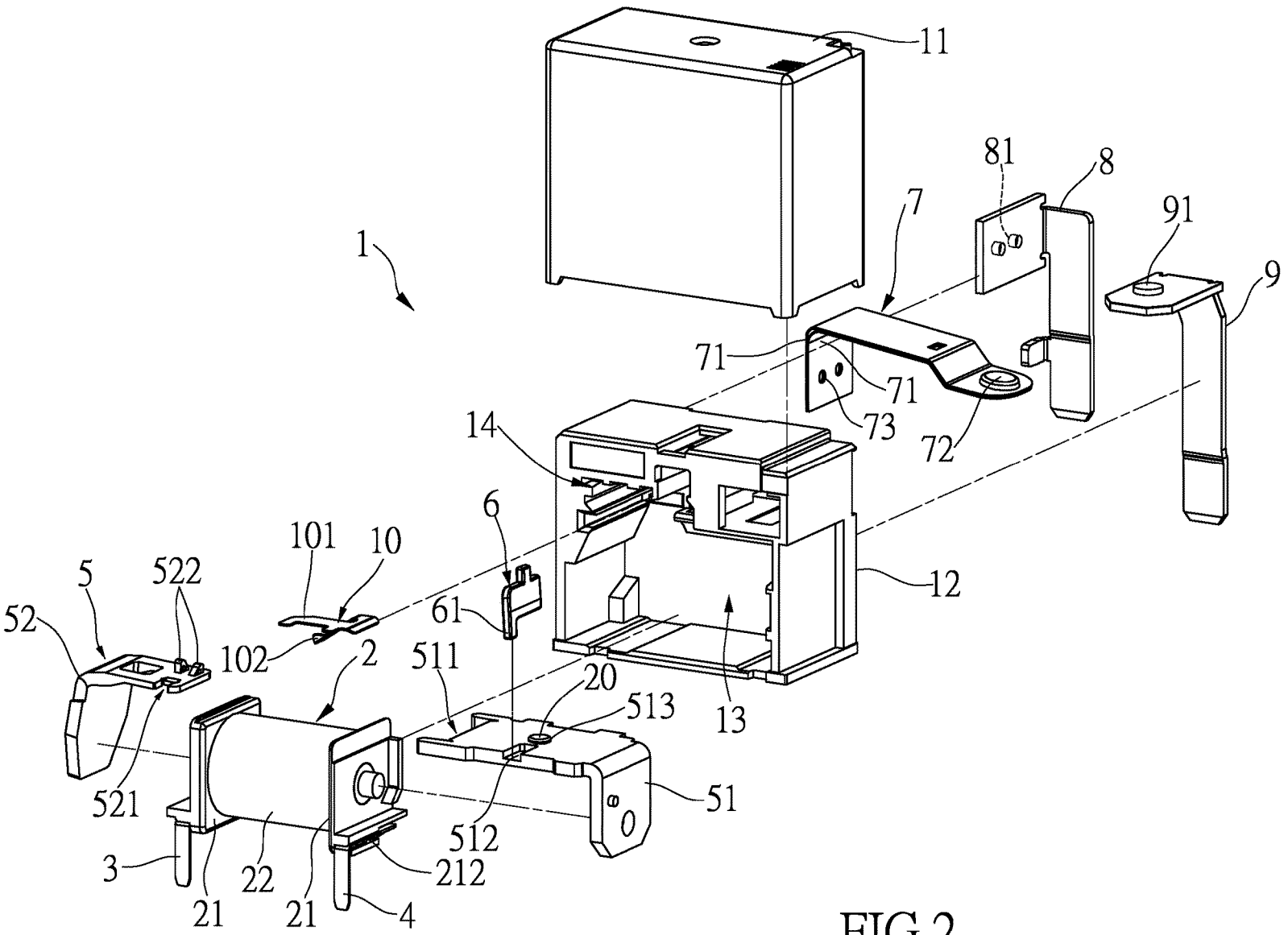
FIG. 2 is a perspective exploded view of a relay structure of the present invention.
Figure 4:
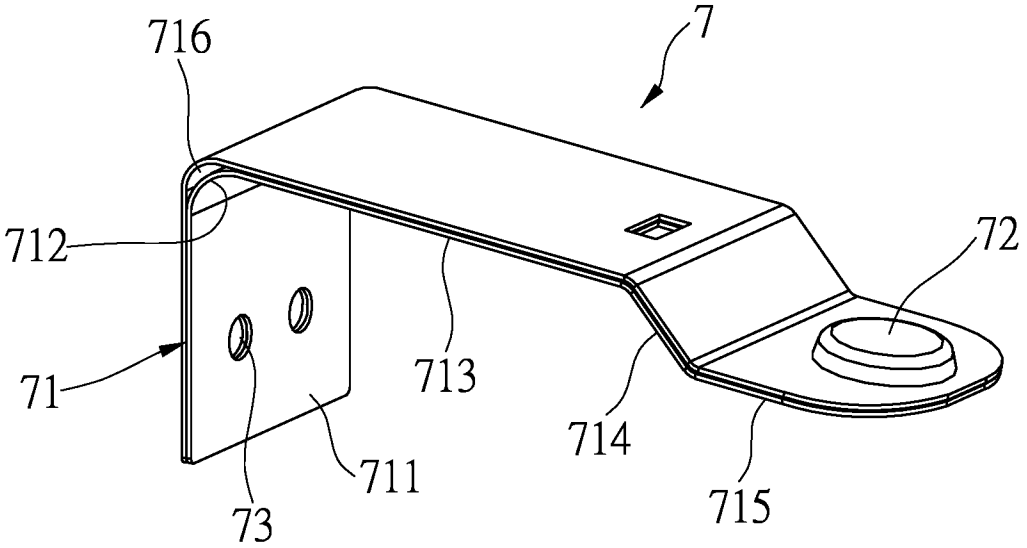
FIG. 4 is a perspective view of an armature assembly of the present invention.
Figure 4A:
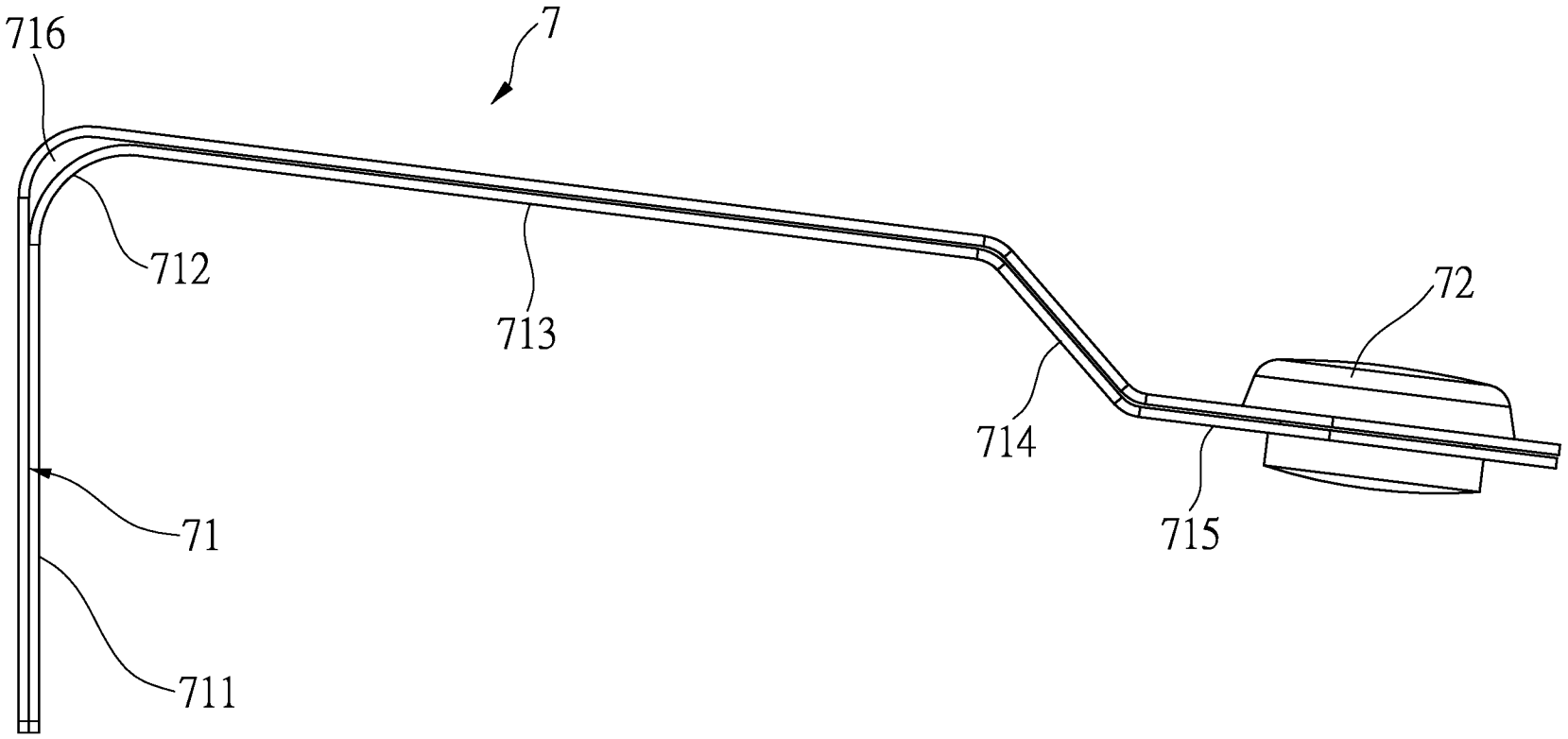
FIG. 4A is an enlarged schematic view of FIG. 4.

One of the conductive plates 71 of the armature assembly 7 is taken as an example for illustration, as shown in FIGS. 4 and 4A, and the conductive plate 71 can be divided into, in the order from the end thereof connected to the third leg 8 to the other end thereof, a first section 711, an arc section 712, a second section 713, an inclined neck section 714 and a third section 715. The first section 711 of the conductive plates 71 are attached with each other and electrically combined with the third leg 8. Unlike the first sections 711 attached with each other, the arc sections 712, the second sections 713, the inclined neck sections 714 and the third sections 715 of the conductive plates 71 are not attached with each other, so as to form an electrically-conductive gap 716. With the configuration of the electrically-conductive gap 716, the area of the armature assembly 7 can include surface areas of the arc sections 712, the second sections 713, the inclined neck sections 714 and the third sections 715 of the conductive plate 71, so that the carrying electrical current can be improved and the heat of the conductive plate 71 can be effectively dissipated through the electrically-conductive gap 716. As a result, the temperature of each conductive plate 71 can be effective reduced, the armature assembly 7 can normally conduct current without being affected by heat, so as to prevent abnormal operation of the relay, as shown in FIGS. 2, 4 and 4A.

Figure 3:
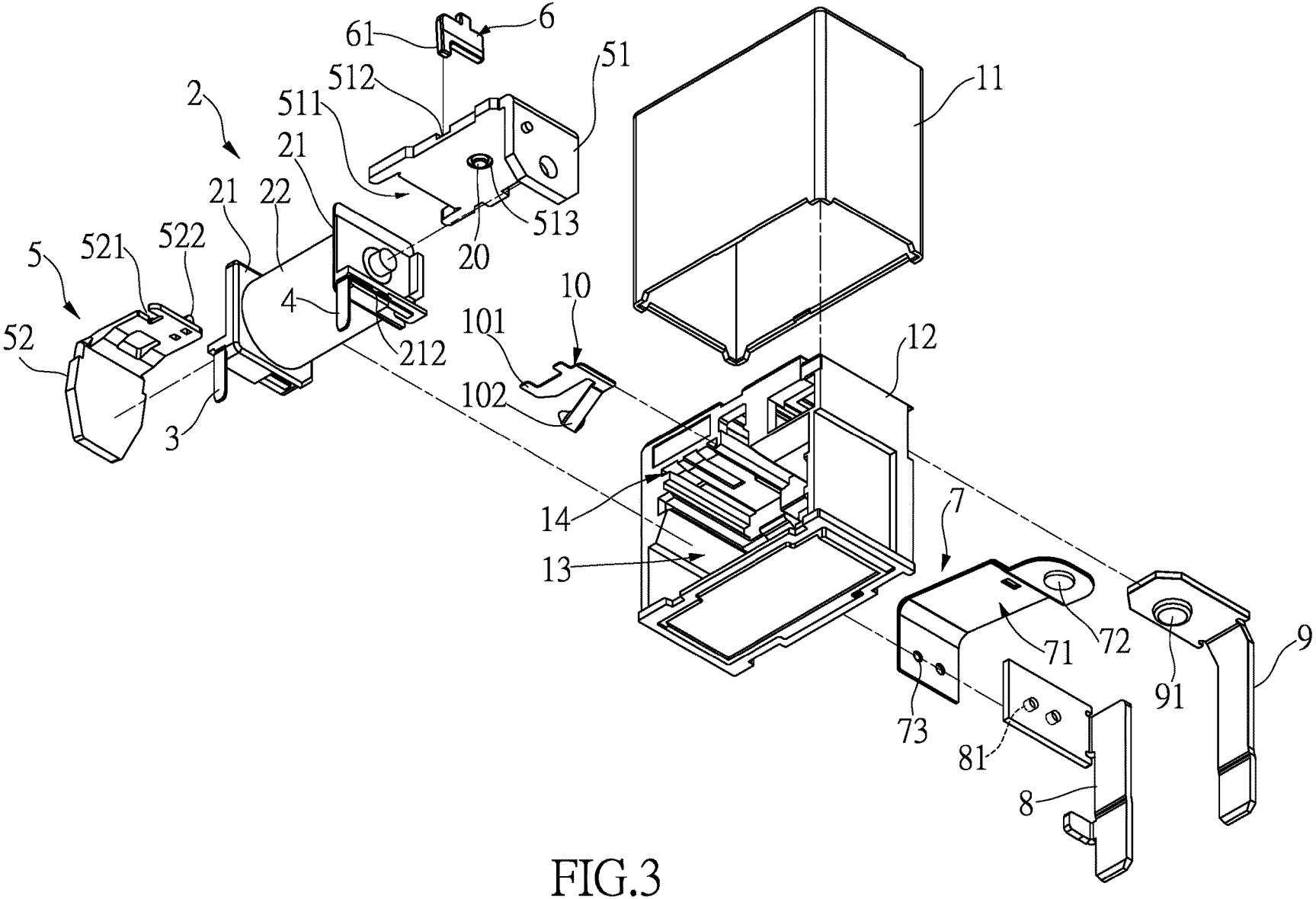
FIG. 3 is a perspective view of a relay structure of the present invention, when viewed from another angle.

The details of other features of the present invention are described in following paragraphs. The magnetoelectric assembly 2 is used to generate electrical power, and includes a two frames 21 and a coil member 22. The two francs 21 are assembled with two ends of the coil member 22, respectively, and one of the two frames 21 magnetically attracted with the magnetic conduction assembly 5 includes a magnetic contact 211, which is electrically connected to the coil member 22. Each frame 21 has an insert slot 212 formed on a bottom thereof and configured to provide the ends of the first leg 3 and the second leg 4 to insert therein, respectively, so that the horizontal ends, of the first leg 3 and the second leg 4 can be slidably inserted into the insert slots 212 easily, respectively, and the other ends of the first leg 3 and the second leg 4 are protruded out of the case 1 to form the pins for plugging with the circuit board, and the configuration of the insert slots 212 can prevent the first leg 3 and the second leg 4 from being loosened to affect conduction of the circuit, as shown in FIGS. 2 and 3. The magnetic conduction assembly 5 includes a fixed magnetic member 51 and a movable magnetic member 52, and an end of the fixed magnetic member 51 is connected to one of the two frames 21 not having the magnetic contact 211, and electrically combined with the coil member 22; other end of the fixed magnetic member 51 is extended toward the conductively connecting member 72 and across the coil member 22, and abutted with the top of the other of the two frames 21. The fixed magnetic member 51 has a notch 511 recessed on the end thereof abutted with the other of the two frames 21. The movable magnetic member 52 is engaged with the notch 511 of the fixed magnetic member 51, to prevent displacement of the movable magnetic member 52 during operation. When the coil member 22 generates electromagnetism, an end of the movable magnetic member 52 is magnetically attracted to contact the magnetic contact 211, and other end of the movable magnetic member 52 passing through the notch 511 and then bent is extended along the direction toward the fixed magnetic member 51, so only the part of the movable magnetic member 52 allocated in the notch 511 is attached with the fixed magnetic member 51, and the movable magnetic member 52 is swingable like a seesaw inside the case 1. The swung movable magnetic member 52 also pushes the driving plate 6 to move, so that the armature assembly 7 enables the conductively connecting member 72 to electrically contact or not contact the contact member 91 based on the vertical displacement of the driving plate 6, as shown in FIGS. 2, 7, 8 and 9.

Figure 8:
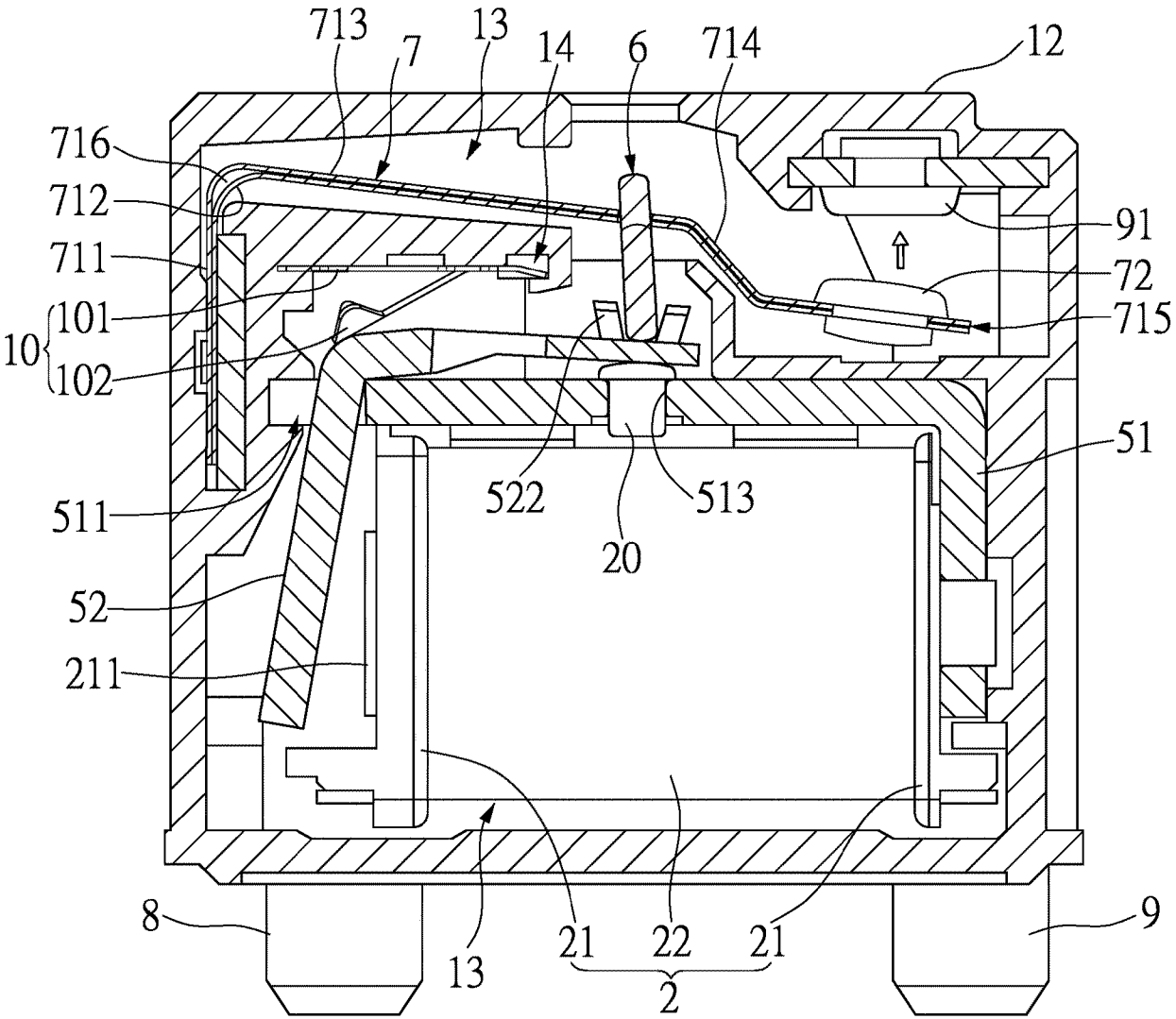
FIG. 8 is a schematic cross-sectional view taken along VIII-VIII of FIG. 5.
Figure 9:
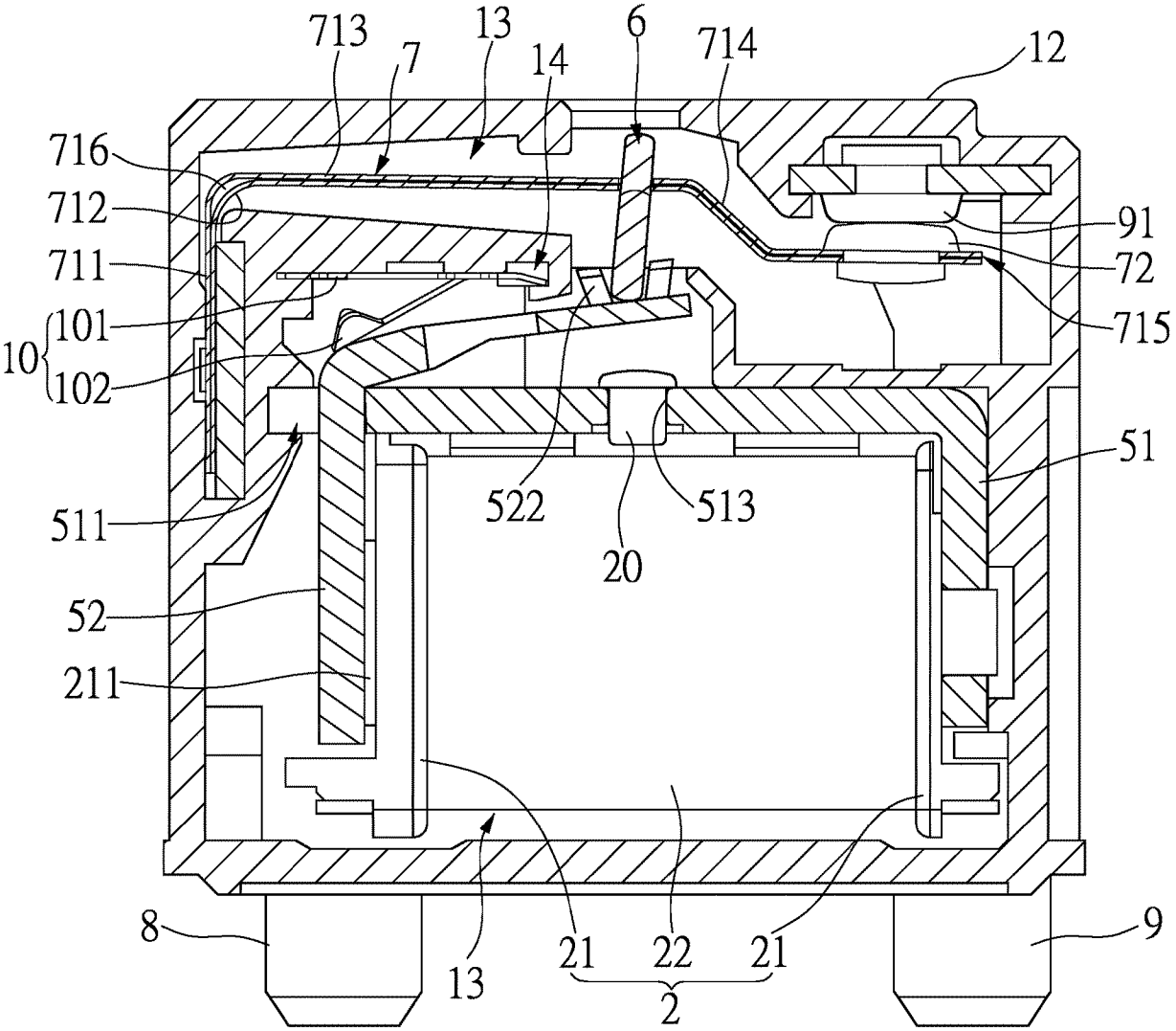
FIG. 9 is a schematic view showing a magnetic attraction operation of the armature assembly of FIG. 8.

After the movable magnetic member 52 is magnetically attracted to swing and the driving plate 6 is driven to upwardly move to make the conductively connecting member 72 of the armature assembly 7 electrically contact the contact member 91, the contact between the movable magnetic member 52 and the magnetic contact 211 can be released by stopping the magnetoelectric assembly 2 generating power. In order to indeed separate the conductively connecting member 72 from the contact member 91 to prevent from the electrical conduction status due to remained magnetic attraction, an elastic recovering member 10 can be disposed in the case 1, and the elastic recovering member 10 includes a fastening plate 101 and an elastic plate 102, the fastening plate 101 is assembled inside the case 1 and between the armature assembly 7 and the movable magnetic member 52, an end of the elastic plate 102 is connected to the fastening plate 101, and other end of the elastic, plate 102 is elastically bent downwardly to press against the movable magnetic member 52. The elastic plate 102 is pushed to slightly deform when the end of the movable magnetic member 52 is electromagnetically attracted to contact the magnetic contact 211, so that the movable magnetic member 52 can be prevented from excessively swinging to affect electrical conduction during repeated operations, as shown in FIGS. 2, 8 and 9.

In order to prevent the movable magnetic member 52 from hitting the fixed magnetic member 51 during the repeated operations, the fixed magnetic member 51 can include a fastening recess 512 recessed on a side thereof and correspondingly in position to the driving plate 6. The movable magnetic member 52 has a fastening notch 521 disposed correspondingly in position to the fastening recess 512, and the fastening notch 521 and the fastening recess 512 in communication with each other. The driving plate 6 has a linking block 61 protruded at a part of the bottom thereof and inserted through the fastening notch 521 and abutted with the bottom of the fastening recess 512. The end, where the linking block 61 is disposed, of the driving plate 6 is partially pushed to the movable magnetic member 52. The fixed magnetic member 51 is fixed, so the movable magnetic member 52 can indeed drive the driving plate 6 to vertically move during the swinging operation of the movable magnetic member 52; when the driving plate 6 is downwardly moved, the linking block 61 is inserted into and fastened with the fastening recess 512, so the linking block 61 is not easy to deviate, thereby maintaining the normal operation of the relay. Besides the configuration of the fastening recess 512 for limiting the recovery position of the driving plate 6, the movable magnetic member 52 can have ribs 522 protruded on top surface of the movable magnetic member 52 and located at two sides of the driving plate 6, respectively, the position of the driving plate 6 is limited between the two ribs 522, so as to prevent the driving plate 6 from skewing and deflecting during movement. The fixed magnetic member 51 can has a through hole 513 cut therethrough and located adjacent to the fastening recess 512, and a cushion 20 can be inserted into the through hole 513. When the movable magnetic member 52 is not in electromagnetic contact with the magnetic contact 211, the movable magnetic member 52 is abutted with the cushion 20 normally, so as to prevent the movable magnetic member 52 from directly hitting the fixed magnetic member 51 during the process of swing to the original position, thereby maintaining the structural completion of the movable magnetic member 52 and the fixed magnetic member 51, as shown in FIGS. 2, 8 and 9.

Figure 5:
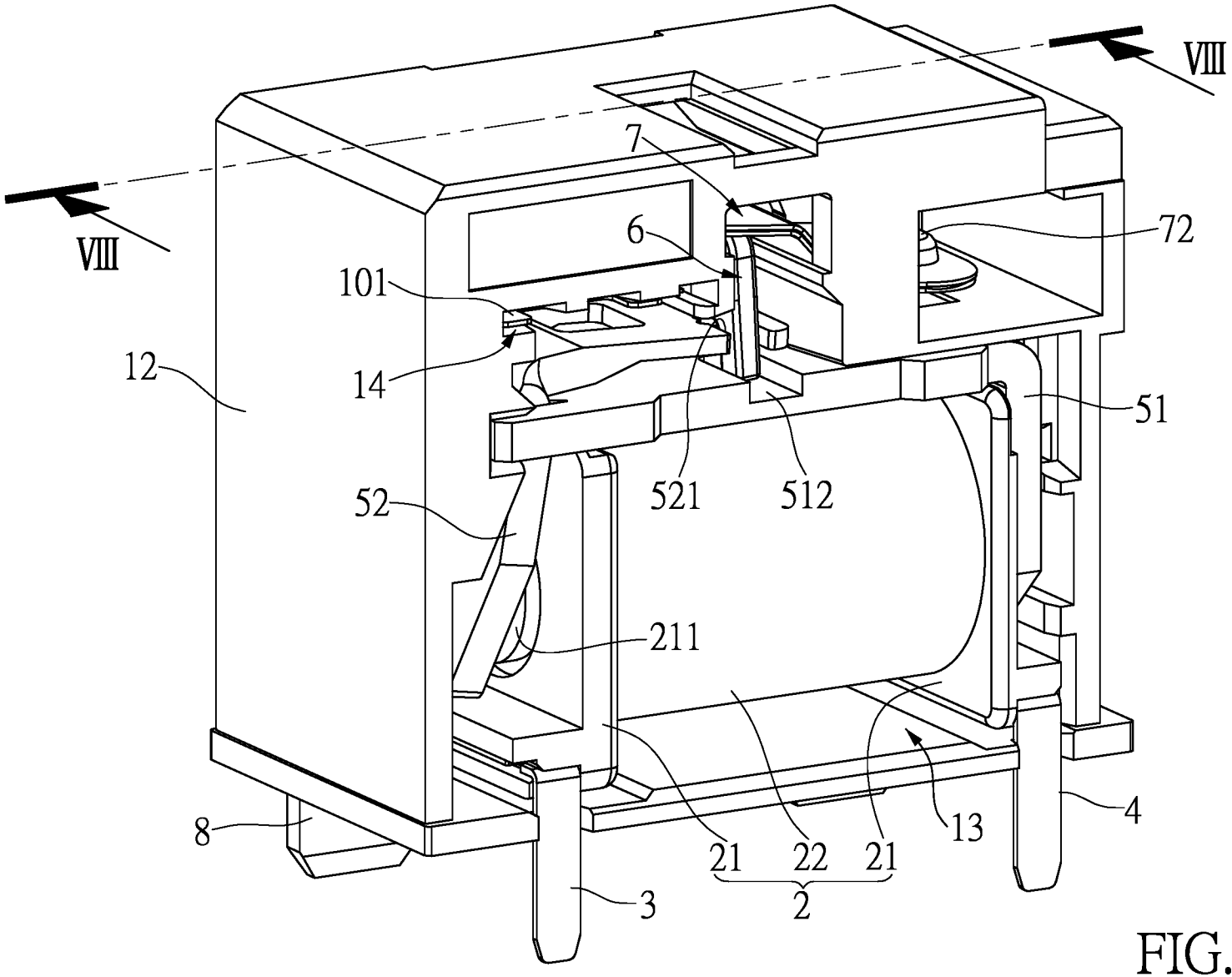
FIG. 5 is a perspective view of a relay structure without a housing, according to the present invention.
Figure 6:
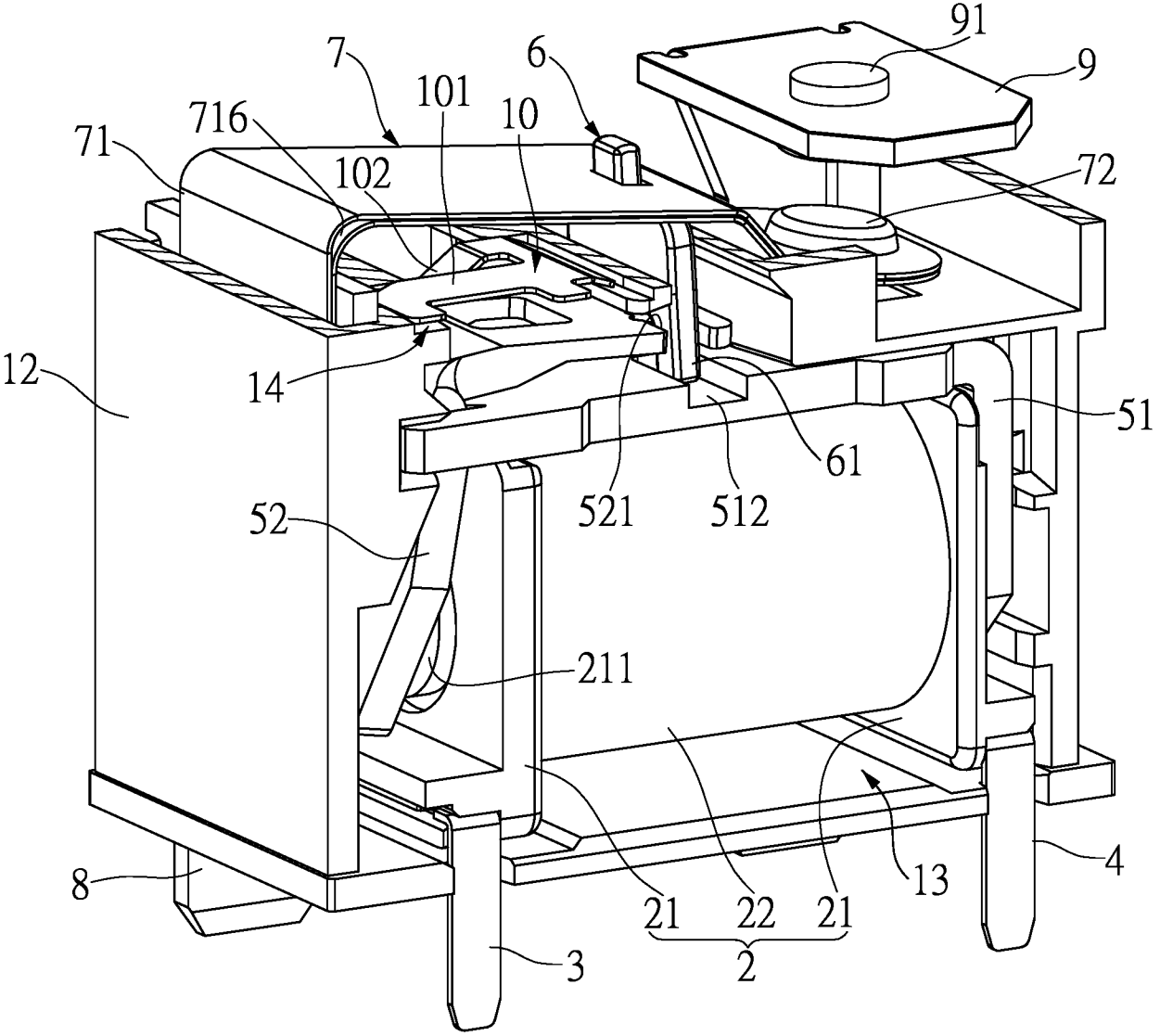
FIG. 6 is a perspective view of the armature assembly of FIG. 5.
Figure 7:
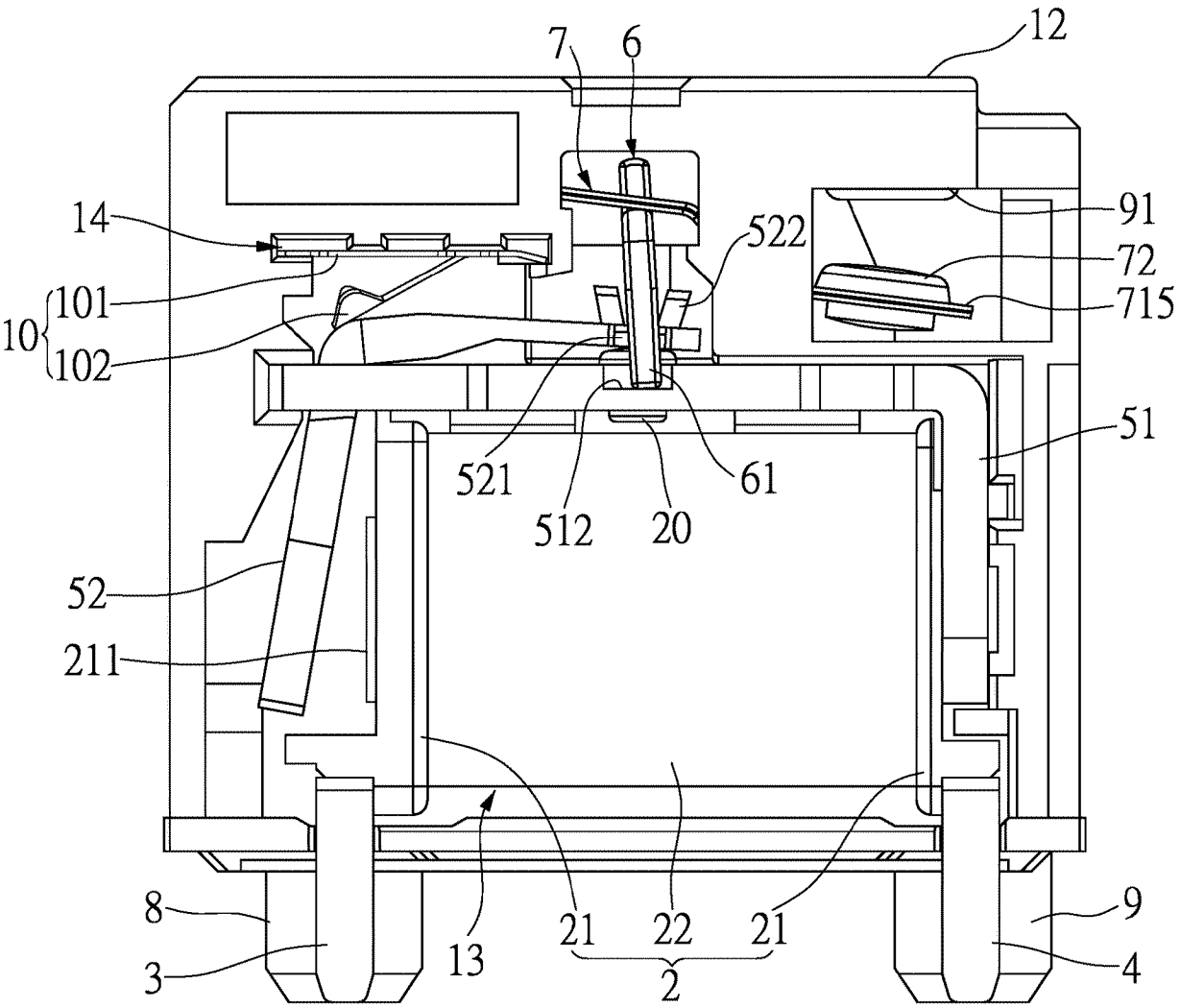
FIG. 7 is a schematic plan view of FIG. 5.

It is worth noting that the case 1 can further include a housing 11 and a main body 12, and the main body 12 is in a hollow shape to define an assembling room 13, the assembling room 13 is partitioned to form a fastening space 14, the fastening plate 101 of the elastic recovering member 10 is fixed in the fastening space 14, and the housing 11 is configured to cover the magnetoelectric assembly 2, the magnetic conduction assembly 5 and the armature assembly 7 disposed inside the main body 12, as shown in FIGS. 2, 5 and 6.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A relay structure, comprising:

a case;

a first leg;

a second leg;

a magnetoelectric assembly disposed inside the case and configured to generate electromagnetism, wherein two ends of the magnetoelectric assembly are electrically assembled with the first leg and the second leg, respectively, and a part of the first leg and a part of the second leg are protruded out of the case;

a magnetic conduction assembly disposed inside the case and around the magnetoelectric assembly, wherein an end of the magnetic conduction assembly is electrically connected to one of the two ends of the magnetoelectric assembly, and other end of the magnetic conduction assembly is magnetically attracted to the other of the two ends of the magnetoelectric assembly when the magnetoelectric assembly generates electromagnetism;

a driving plate assembled on a top surface of the magnetic conduction assembly;

a third leg;

an armature assembly disposed inside the case and electrically connected to an end of the third leg, wherein the other end of the third leg is protruded out of the case, the armature assembly further comprises a plurality of conductive plates, each of the plurality of conductive plates has a part stacked and attached with another one of the plurality of conductive plates, and other part stacked hut not attached with another one of the plurality of conductive plates, an end of the armature assembly is bonded with the third leg, and other end of the armature assembly is extended toward the driving plate and formed with a conductively connecting member, and a top end of the driving plate is inserted through the plurality of conductive plates, each of the plurality of conductive plates divided into a first section, an arc section, a second section, an inclined neck section and a third section, the first sections of the plurality of conductive plates attached with each other and electrically combined with the third leg, an electrically-conductive gap formed between the arc sections, the second sections, the inclined neck sections and the third sections of the plurality of conductive plates, the conductively connecting member inserted through the third sections of the plurality of conductive plates, a top end of the driving plate inserted through the second sections of the plurality of conductive plates and near the inclined neck section; and a fourth leg having an end disposed inside the case and other end protruded out of the case, wherein the end of the fourth leg disposed inside the ease is formed with a contact member above the conductively connecting member.

2. The relay structure according to claim 1, wherein the magnetoelectric assembly further comprises two frames and a coil member, the two frames are assembled with two ends of the coil member, respectively, and one of the two frames magnetically attached with the magnetic conduction assembly further comprises a magnetic contact disposed thereon and electrically connected to the coil member, wherein each of the two frames has an insert slot formed on a bottom thereof, and the ends of the first leg and the second leg are inserted into the insert slots of the two frames, respectively.

3. The relay structure according to claim 2, wherein the magnetic conduction assembly comprises a fixed magnetic member and a movable magnetic member, an end of the fixed magnetic member is connected to the one of the two frames not having the magnetic contact, and the other end of the fixed magnetic member is extended toward the conductively connecting member and across the coil member to abut with a top of the other of the two frames, and the fixed magnetic member has a notch recessed on the end thereof abutted with the other of the two frames;

wherein the movable magnetic member is abutted with the notch of the fixed magnetic member, and when the coil member generates electromagnetism, the end of the movable magnetic member magnetically attracts and contacts the magnetic contact, and other end of the movable magnetic member is disposed through the notch and bent to form a bent part, and extended along but not in contact with the fixed magnetic member.

4. The relay structure according to claim 3 wherein the fixed magnetic member has a fastening recess recessed on a top surface of a side thereof corresponding in position to the driving plate, the movable magnetic member has a fastening notch disposed correspondingly in position to the fastening recess, the driving plate has a linking block protruded on a part of a bottom thereof and through the fastening notch to abut with a bottom of the fastening recess, wherein the movable magnetic member has two ribs protruded on top surface thereof and located two sides of the driving plate, respectively, and the driving plate is clamped between the two ribs, wherein the fixed magnetic member has a through hole cut therethrough and formed adjacent to the fastening recess, and a cushion is inserted into the through hole, the movable magnetic member is abutted with the cushion in a normal condition in which the movable magnetic member is not in electromagnetic contact with the magnetic contact.

5. The relay structure according to claim 3, further comprising an elastic recovering member disposed inside the case, wherein the elastic recovering member comprises a fastening plate and an elastic plate, the fastening plate is engaged in the case and disposed between the armature assembly and the movable magnetic member, an end of the elastic plate is connected to the fastening plate, and another end of the elastic plate is downwardly bent to press against the bent part of the movable magnetic member.

6. The relay structure according to claim 5, wherein the case further comprises a housing and a main body, and the main body is a hollow shape to define an assembling room, the assembling room is partitioned to form a fastening space, the fastening plate of the elastic recovering member is fastened in the fastening space, the housing is configured to cover the magnetoelectric assembly, the magnetic conduction assembly and the armature assembly disposed inside the main body.

* * * * *